United States Patent [19]

Ikehata et al.

[11] Patent Number: 4,916,422

[45] Date of Patent: Apr. 10, 1990

[54] APPARATUS FOR ELECTRICALLY OPERATING A CIRCUIT BREAKER

[75] Inventors: Yoji Ikehata; Tadayoshi Onoda, both of Hiroshima, Japan

[73] Assignee: Mitsubishi Denki Kabushiki Kaisha, Tokyo, Japan

[21] Appl. No.: 210,350

[22] Filed: Jun. 23, 1988

[30] Foreign Application Priority Data

Jun. 25, 1987 [JP] Japan ..... 62-97713

[51] Int. Cl.[4] ..... H01H 3/00

[52] U.S. Cl. ..... 335/190; 200/17 R; 200/573

[58] Field of Search ..... 200/17 R, 18, 47, 30 R, 200/318-323, 400, 501, 573, 574; 335/166, 167, 171, 172, 185, 186, 189, 190

[56] References Cited

U.S. PATENT DOCUMENTS 4,137,439 1/1979 MacLean ..... 200/573 X

FOREIGN PATENT DOCUMENTS 1309509 3/1973 United Kingdom .

*Primary Examiner*—J. R. Scott

*Attorney, Agent, or Firm*—Burns, Doane, Swecker & Mathis

[57] ABSTRACT

An apparatus for electrically operating a circuit breaker comprising an electrically powered pawl which is driven by an electric motor for causing a ratchet to rotate and a release mechanism for causing the electrically powered pawl to move out of driven engagement with the ratchet when the ratchet rotates to a predetermined angle. A guide bar on which a spring is mounted is secured on a main frame. A slider is slidably provided on the guide bar. The slider engages with a handle of the circuit breaker and throws the circuit breaker when it slides on the guide bar. The slider is driven into sliding motion by a cam which rotates with the ratchet gear in a unitary motion and the slider compresses the spring on the guide bar. When the slider reaches up a position where the circuit breaker is turned off, the release mechanism causes the electrically powered pawl to move out of driven engagement with the ratchet.

2 Claims, 10 Drawing Sheets

APPARATUS FOR ELECTRICALLY OPERATING A CIRCUIT BREAKER

BACKGROUND OF THE INVENTION

1. Field of the Invention

This invention relates to an apparatus for electrically operating a circuit breaker in which a spring is compressed by means of a rotating motor and mechanical energy stored within the spring is released to shut off the circuit breaker.

2. Prior Art

One of such apparatuses for electrically operating a circuit breaker is arranged as shown in FIG. 7 to FIG. 10.

The OFF-operation of this apparatus to open the circuit will be described with reference to FIG. 7 to FIG. 10. A frame 3 of a prior art apparatus is secured in front of a circuit breaker 1. An electric motor 4 is secured on the frame 3 and the rotation of the motor 4 is transmitted to a main shaft 6 which drives a ratchet gear 5 via a reduction gear 8. The main shaft 6 is connected to the motor via a one way clutch 7. The ratchet gear 5 is provided with a cam 11, which rotates together with the ratchet 5 in a unitary motion. The can 11 engages with a roller 17 journaled for free rotation on a side wall 12*b* of a slider 12 for causing the slider 12 to slide. A guide rod 14 is secured to the frame 3. The guide rod 14 extends through a rod insertion hole 15 provided on a front wall 12*a* of the slider 12.

Thus the slider 12 is guided by the guide rod 14 to slide thereon. A spring 16 is attached to the guide rod 14. The slider 12 is provided with two handle drive pins 13 to drive a handle 2 of the circuit breaker 1.

When an OFF signal is supplied, the motor 4 drives the main shaft 6 in rotation via the ruduction gear 8 and the one way clutch 7, thereby causing the ratchet gear 5 to rotate in a direction of an arrow A in FIG. 7. The can 11 also rotates with the ratchet gear 5 in the direction A, then moves into contact engagement with the roller 17 for causing the slider 12 to slide in a direction of an arrow B. At this time the front wall 12*a* of the slider 12 compresses the spring 16 as shown in FIG. 8, while also throwing the handle 2 into the OFF-position of the circuit breaker 1 by means of the handle drive pins 13. A stop lever 19 is swingably mounted on the side wall 12*b* of the slider 12. The side wall 12*b* is provided with a guide and stopper pin 23 to engage with an elongate hole of the stop lever 19. The stop lever 19 is urged against the side wall 12*b* by means of a twist spring 20 as shown in FIG. 10. The stopper pin 21 of the cam 11 engages with a bent portion of the stop lever 19 for causing the stop lever 19 to swing against the twist spring 20. Moving in the direction B, the slider 12 moves to a position where the circuit breaker 1 becomes OFF to open the circuit and then the stop lever 19 engages with an actuating lever of a limit switch 18. When the ratchet gear 5 further rotates, the cam 11 causes the stop lever 19 to swing in a direction of an arrow C against the twist spring 20. In this manner, the stop lever 19 actuates the limit switch 18 to stop the motor 4. The stopper pin 23 terminates swinging motion of the stop lever 19 as shown in FIG. 9, so that overrun of the cam 11 is prevented. The slider 12 is held by a latch mechanism 22 at a position shown in FIG. 9. The latch mechanism 22 is to hold both the slider 12 and the spring 15 at a position at which the spring 16 is urged. The latch mechanism 22 is arranged by a link 22*a* of the slider 12 and a latch (not shown) of the frame 3. Additionally the ratchet gear 5 is provided with a fixed pawl 33 to prevent reverse rotation thereof.

In FIG. 10, operating a manual operation handle 9 in a pumping fashion permits rotation of the ratchet 5 in the direction A shown in FIG. 7. Thus, the off-operation manual of the circuit breaker can be effected in a manner similar to the operation by the motor 4. In the manual mode, the motor 4 is disconnected with the aid of the one way clutch 7.

The ON-operation of this conventional apparatus to open the circuit will now be described with reference to FIG. 9 which shows the OFF state of the circuit breaker. When the latch 22 is actuated upon operation of an ON signal, the slider 12 is set free from being latched and the stored mechanical energy of the compressed spring 16 is released. The slider is then pushed out by the spring 16 to slide in a direction of an arrow D while at the same time the stop lever 19 moves in the direction D, during which the slider 12 throws the handle 2 into ON position by means of the handle drive pins 13 as shown in FIG. 7.

With the conventional apparatus for electrically operating a circuit breaker thus far described, it is necessary to stop the motion of the cam 11 at a specific location so that the cam 11 and the roller 17 are positioned within a predetermined area after the OFF-operation is completed. For this purpose, a special type of brake such as reverse rotation was applied to bring the motor 4 to a stop, or mechanical strength of the bent portion which serves to stop the further swing motion of the stop lever 19 was increased, thereby preventing overrun of the cam 11 due to inertial rotation of the electric motor 4. Also in the case of malfunction of a limit switch 18 which operatively engages with the cam 11 to switch off the motor 4, there have been shortcomings in which the stopper portion of the cam 11 is damaged or the motor 4 burns out due to overload.

SUMMARY OF THE INVENTION

The present invention was made to solve the problems described above. An object of the invention is to provide an apparatus for electrically operating a circuit breaker in which an electric motor needs no special braking devices to set the circuit breaker to the OFF-state. Another object of the invention is to provide an apparatus for electrically operating a circuit breaker which can prevent burning of the electric motor, which tends to continue rotating against the braking force of a stopper when a switch for closing and opening the motor circuit malfunctions. Still another object of the invention is to provide an apparatus for electrically operating a circuit breaker which eliminates the influence of overrun of the motor due to inertial rotation after it is switched off, thereby preventing damage to the stopper portion. An apparatus for electrically operating a circuit breaker according to the invention is provided with an electrically powered pawl which is driven by an electric motor for causing a ratchet gear to rotate, and a release mechanism which causes a switch of the electric motor circuit and the electrically powered pawl to become out of engagement with the ratchet gear. With this apparatus, the cam which rotates with the ratchet gear in a unitary motion, engages with a stop lever for causing it to pivot.

BRIEF DESCRIPTION OF THE DRAWINGS

The foregoing objects and advantages will be better understood from the following description with reference to the accompanying drawings, in which.

In these Figures, like elements have been given like numerals; and

DESCRIPTION OF THE PREFERRED EMBODIMENTS

Figure 1:
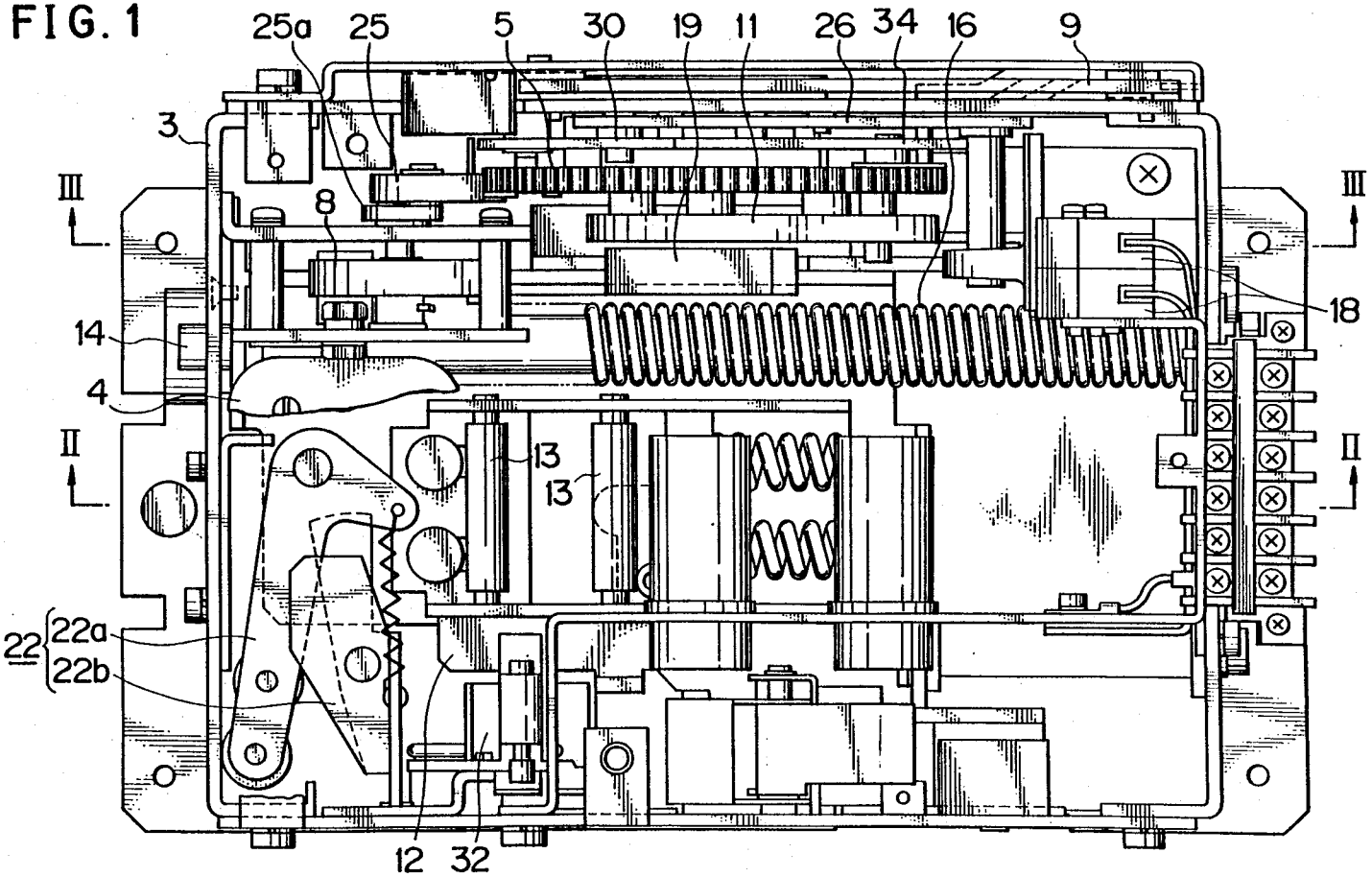
FIG. 1 is a top view depicting the inside of an apparatus according to the invention.

The OFF-operation of an apparatus for electrically operating a circuit breaker according to the invention will now be described with reference to FIGS. 1 to 3.

Figure 5:
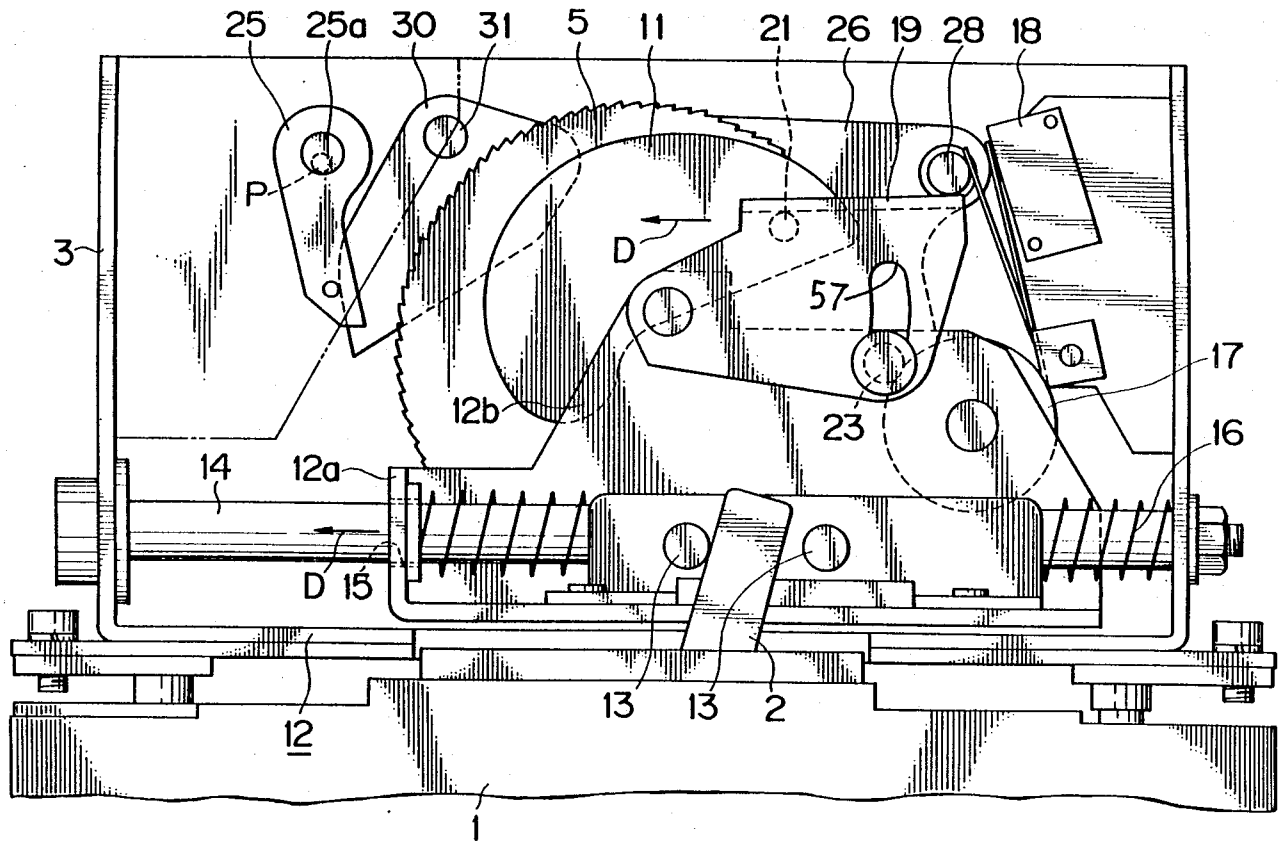
FIG. 5 is a diagram similar to FIG. 3 for illustrating the spring which has been compressed.

A main frame 3 of the apparatus is attached in front of a circuit breaker 1. Provided on the frame 3 provided are an electric motor 4 and an electrically powered pawl 25. This electrically powered pawl 25 is rotatably supported by an eccentric shaft 25*a* and is connected to the electric motor 4 via a reduction gear 8. The tip end of the pawl 25 is always urged toward the ratchet gear 5 by means of a spring. A first release plate 26 is swingably supported on the frame 3 by means of a first pivot pin 27. The first release plate 26 has a release strip 29 formed integrally therewith. Similarly a second release plate 30 is swingably supported on the frame 3 by means of a second pivot pin 31. An elongate hole 30*a* at one side of the second release plate 30 is linked to a pin 26*a* of the first release plate 26. A cam 11 is attached to the ratchet gear 5 and rotates with the ratchet 5 in a unitary motion. The ratchet gear 5 is prevented from reverse rotation by means of a fixed pawl 33 which is urged by a spring (not shown) against the ratchet gear 5. The cam 11 engages with a roller 17 which is journaled at a side all 12*b* of the slider 12 to slide the slider 12. A guide rod 14 is secured to the frame 3 and extends through a rod insertion hole 15 provided on a side wall 12*a* of the slider 12. Thus the slider 12 is guided by the guide rod 14 to slide. A spring 16 is attached to the guide rod 14. The electric motor 4, when started upon an OFF-operation signal, drives the eccentric shaft 25*a* via a reduction gear 8 in eccentric motion about an axis P for causing the ratchet gear 5 to rotate in a direction of an arrow A. The cam 11 rotates with the ratchet gear 5 in the direction A, and then engages with the roller 17 for causing the slider 12 to slide in the direction of B, during which the slider 12 urges the spring 16 as shown in FIG. 5 while also throwing a handle 2 to an OFF-position by means of handle drive pins 13.

Figure 6:
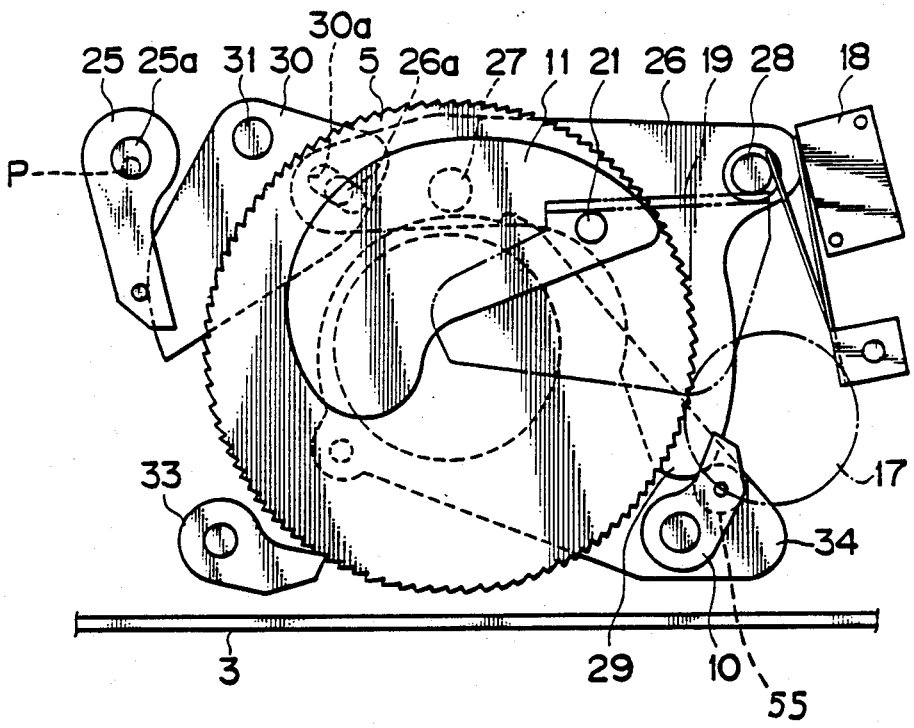
FIG. 6 is a diagram similar to FIG. 3 for illustrating the spring which has been compressed.
Figure 7:
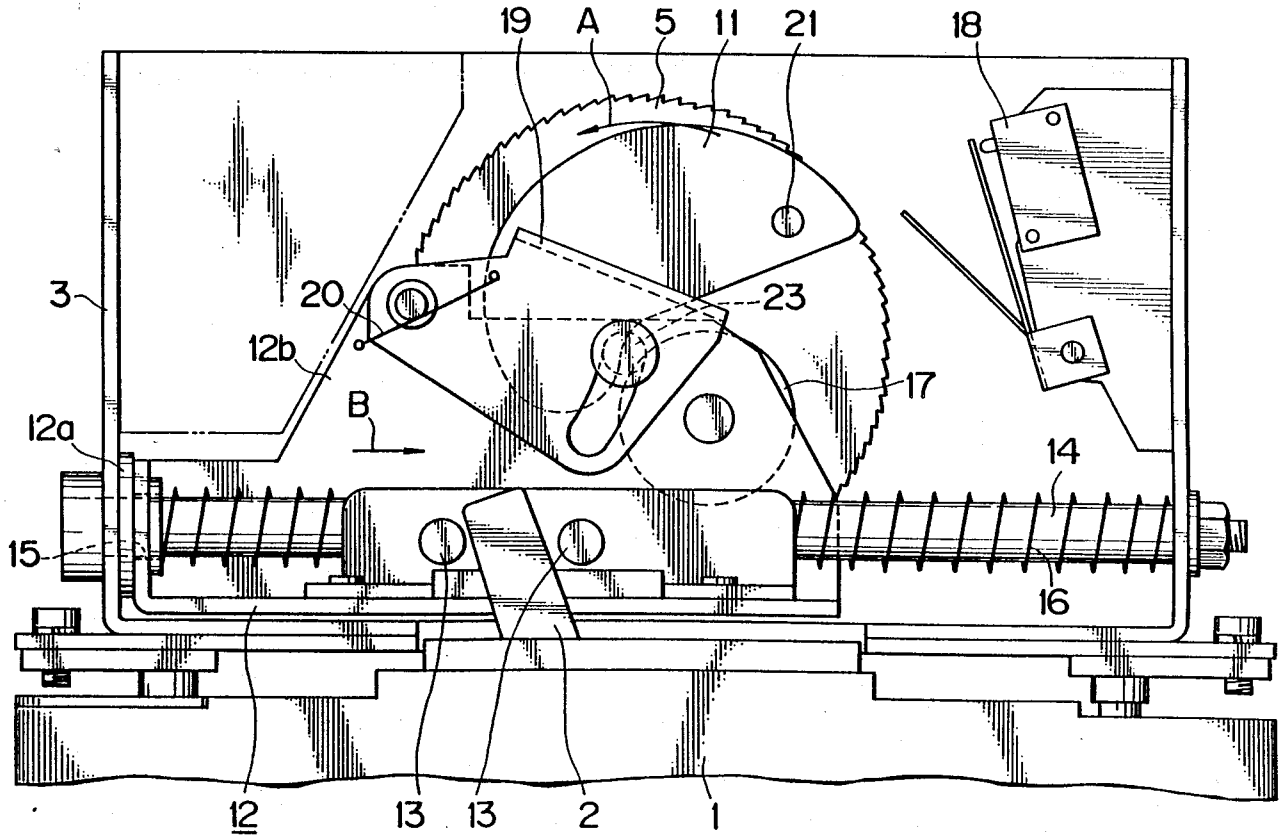
FIG. 7 PRIOR ART
FIG. 7 is a side view of a conventional apparatus for showing the spring which has been released completely.
Figure 8:
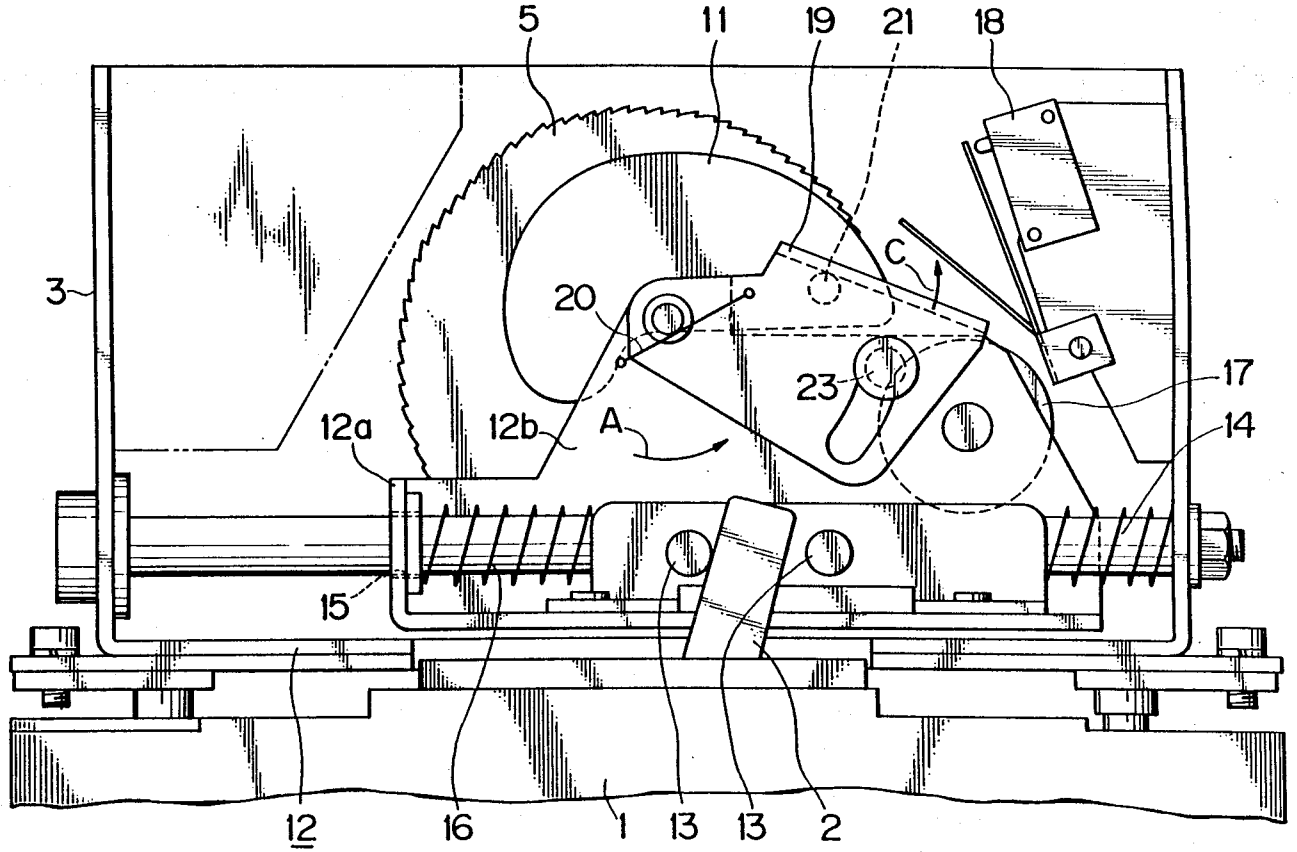
FIG. 8 PRIOR ART
FIG. 8 is a side view of the conventional apparatus, showing the spring which is being compressed.
Figure 9:
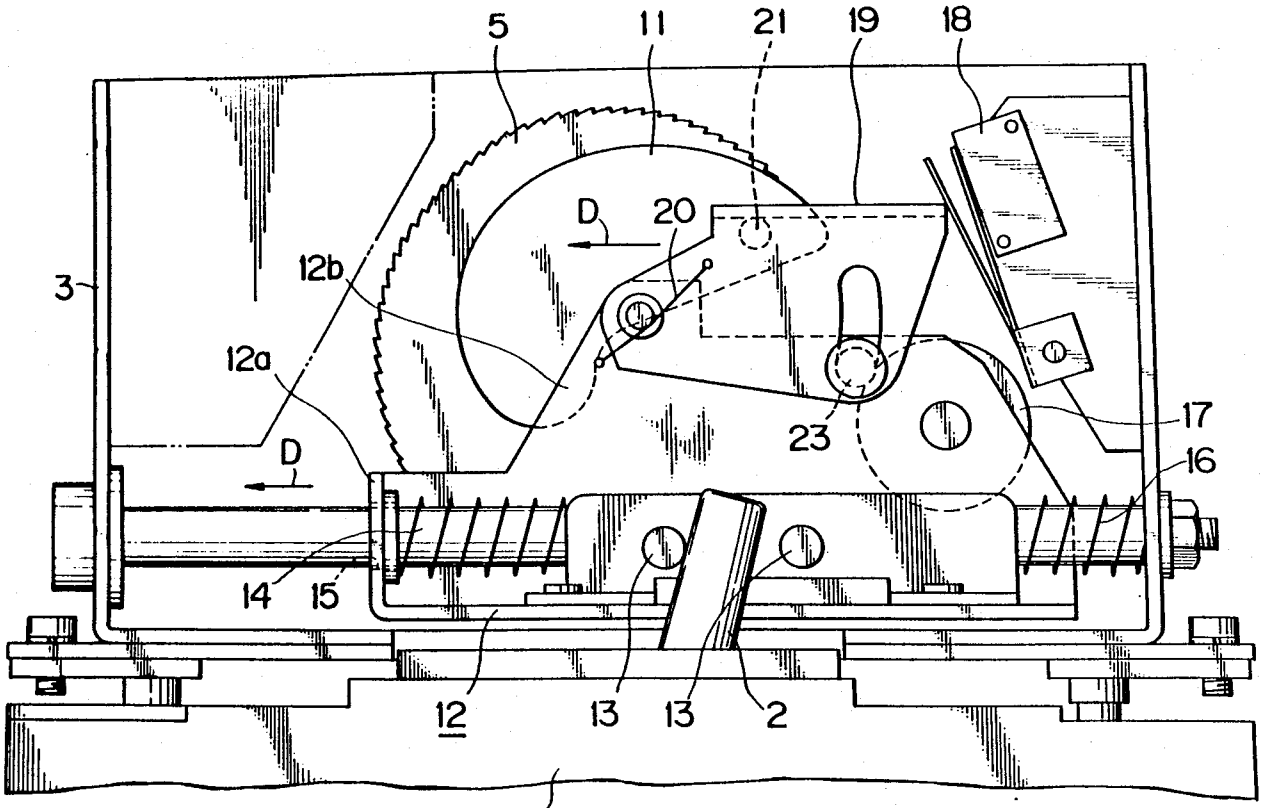
FIG. 9 PRIOR ART
FIG. 9 is another side view of the conventional apparatus for showing the spring which has been compressed completely.
Figure 10:
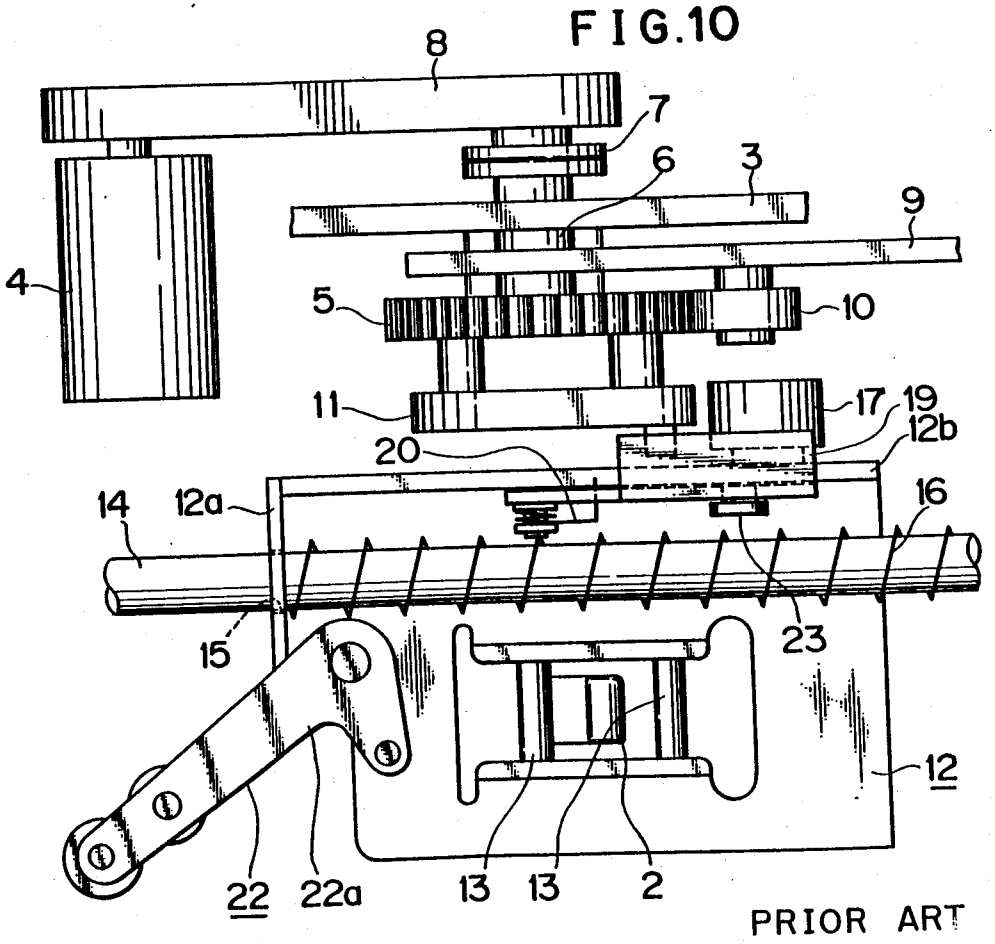
FIG.10 PRIOR ART
FIG. 10 is a general top view of FIG. 9.

A stop lever pin 21 of the cam 11 engages with a stop lever 19 for causing the the stop lever 19 to swing further against a twist spring 20 (not shown, although similar to the twist spring 20 illustrated in FIGS. 7–10), whereby the release pin 28 of the first release plate 26 actuates a limit switch 18 to bring the motor to a stop. FIG. 5 shows that the circuit breaker 1 is in OFF state thereof. A stopper pin 23 is provided on a side wall 12*b* of the slider 12. The stopper pin 23 is in insertion engagement with an elongate hole 57 of the stop lever 19 to stop swing motion of the stop lever 19. Simultaneously, the second release plate 30 is driven by pivotal motion of the first release plate 26 which is caused by movement of the release pin 28. The second release plate 30 then swings about the second pivot pin 31 to push the electrically powered pawl 25 at a pin thereof to be out of driven engagement with the ratchet gear 5. That is, the circuit breaker 1 becomes off with spring 16 being urged fully as shown in FIG. 5. When the cam 11 takes up a predetermined position, the limit switch 18 switches the electric circuit of the motor 4 while at the same time the electrically powered pawl 25 is released out of mechanical engagement with the ratchet gear 5, thereby preventing overrun of the cam 11 due to inertial rotation of the electric motor 4. Also with the spring 16 being biased as shown in FIG. 5 and FIG. 6, a manual pawl 10 is pushed at a pin thereof by the release strip 29 to be out of driven engagement with the ratchet gear 5. Therefore, an operator cannot feel any resistance even if he operates a manual operation lever 34 by means of a manual operation handle 9 connected to the manual operation lever, thus confirming that the spring 16 is certainly biased.

Figure 11A:
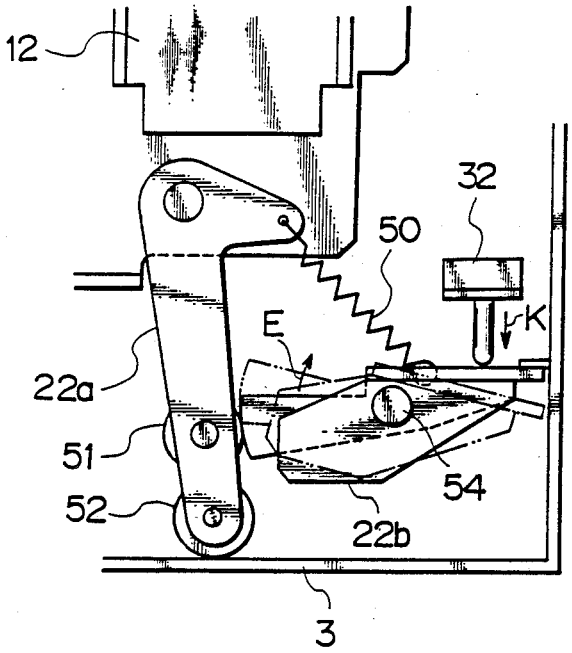
FIG. 11*a* shows a latch mechanism in OFF state of the circuit breaker.
Figure 11B:
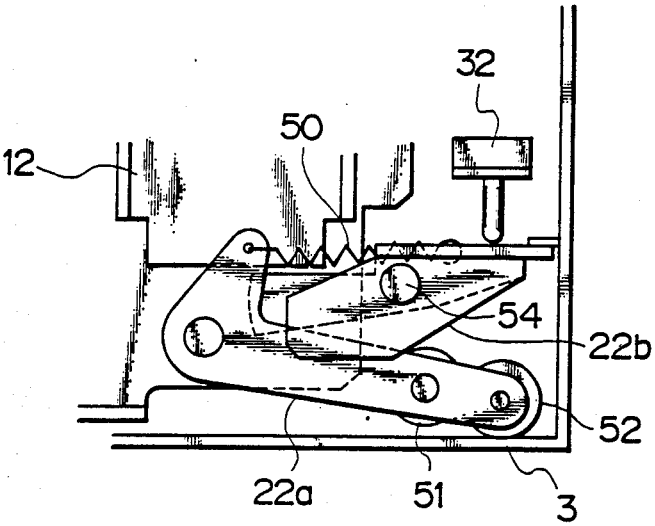
FIG. 11*b* shows a latch mechanism in ON state of the breaker.

A latch mechanism 22 is to maintain both slider 12 and the spring 16 at a position at which the spring 16 is urged fully and is formed of a link 22*a* of the slider 12 and a latch 22*b* on the frame 3 as shown in FIG. 11*a* and FIG. 11*b*. FIG. 11*a* shows the latch mechanism 22 when the circuit breaker 1 is in the OFF state.

The ON-operation of a circuit breaker which is performed by the apparatus according to the invention will now be described with reference to FIG. 5, FIG. 6 and FIGS. 11*a* and 11*b* as follows. FIG. 11*a* shows the latch mechanism when the circuit breaker 1 is in the OFF state. The link 22*a*, a spring 50, the latch 22*b*, and repulsive force of the spring 16 are in equilibrium.

When a solenoid 32 is energized upon an ON operation signal to kick the latch 22*b* in a direction of K, the latch 22*b* rotates momentarily about pin 54, which supports the latch 22*b* rotatably on the frame 3, in a direction of E to move out of depressive engagement with the roller 51, thereby disabling the latch. A freely rotatable roller 52 is positioned at the end of the link 22*a*. The roller 52 moves along the inner wall of the frame 3 in order to assist the smooth pivoting movement of the link 22*a* when the solenoid 32 is energized upon the supply of an ON operating signal. The latch mechanism 22 releases the slider 12 and the stored compressive spring energy of the spring 16 is discharged to slide the slider 12 in the direction D. The stop lever 19 also moves in the direction D at the same time. At this time the slider 12 throws the handle 2 into the ON position by means of handle drive pins 13 as shown in FIG. 2. FIG. 11*b* shows the latch mechanism when the circuit breaker 1 is in ON state.

Figure 2:
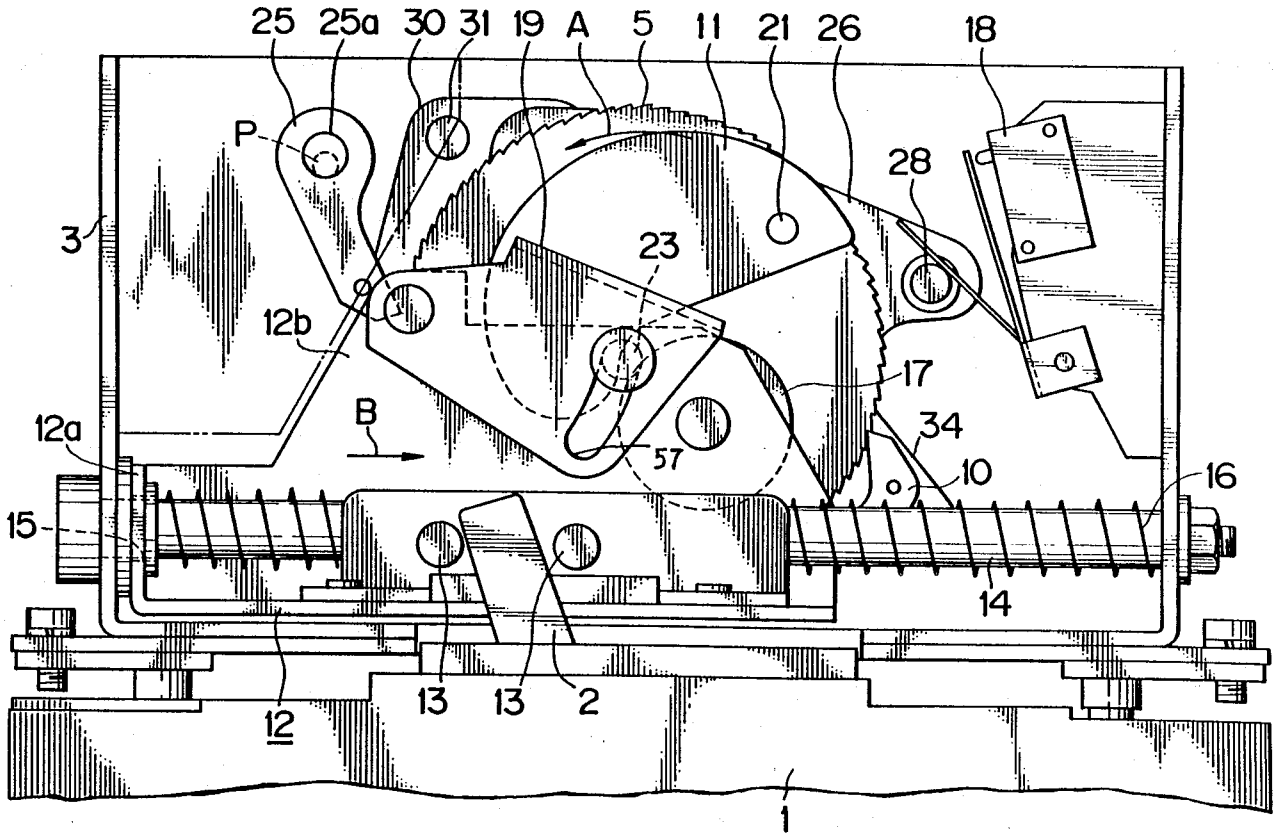
FIG. 2 is a cross sectional view taken along the line II—II of FIG. 1.
Figure 3:
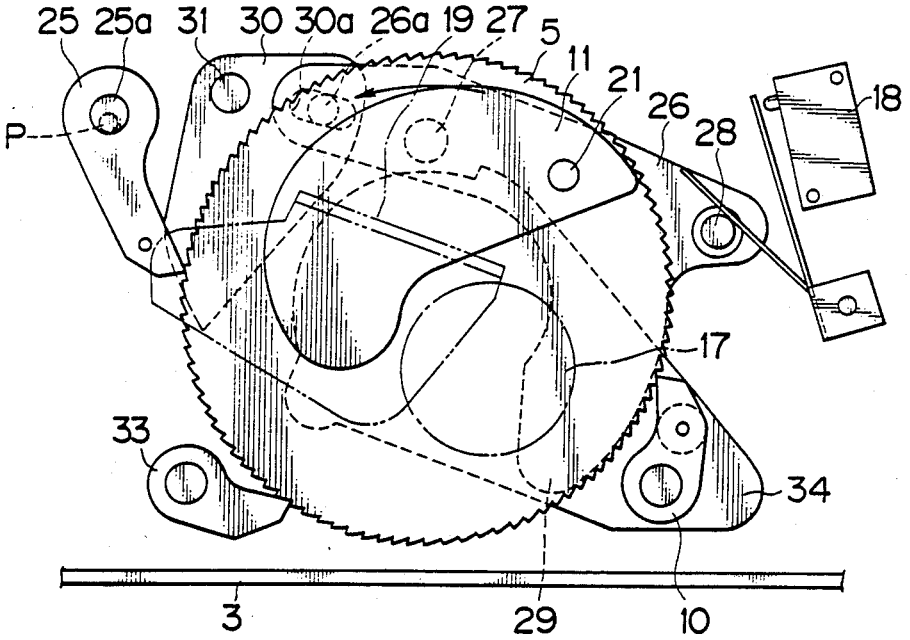
FIG. 3 is a cross sectional view in part taken along the line III—III of FIG. 1.
Figure 4:
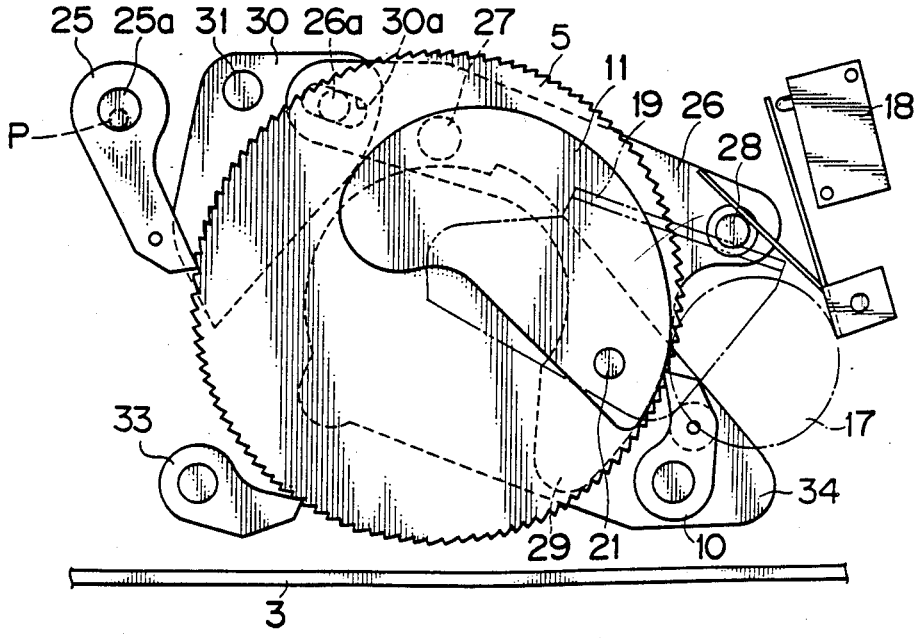
FIG. 4 is a diagram similar to FIG. 3 for illustrating a spring which is being compressed.

In addition, operating the manual operation handle 9 in a pumping fashion can cause rotation of the ratchet gear 5 in the direction A in FIG. 2. Thus, the OFF-operation of the circuit breaker can be effected in a manner similar to the operation by the motor 4. When the stop lever 19 moves in the direction D in FIG. 5, the release pin 28 will be out of engagement with the limit switch 18 causing the first release plate 26, the second release plate 30 and a release strip 29 to return to their initial positions. Thus the electrically powered pawl 24 will again slip into mesh engagement with the ratchet gear 5 as shown in FIG. 3, while at the same time the limit switch 18 returns to its initial state. In the embodiment thus far described, a spring or a similar urging member (not shown) may be provided to urge the first and the second release plates 26 and 30 so that they are maintained in a mechanical positional relation as shown in FIG. 3 for the stable operation.

What is claimed:

1. An apparatus for electrically operating a circuit breaker comprising:

a frame;

a ratchet gear rotatably supported on said frame and provided with a cam thereon, said cam rotating with said ratchet gear in a unitary motion;

an electric motor mechanically coupled to said ratchet gear and provided on said frame for driving said ratchet gear into rotation when an OFF operation signal is supplied;

a limit switch operated through rotation of said cam for switching off said electric motor when said cam rotates to a predetermined position;

a stop lever pivotally supported on said frame and being engaged by said cam, said stop lever actuating said limit switch when said stop lever is driven by the cam in rotational motion;

a guide bar secured at both ends thereof to said frame and a spring mounted on said guide bar;

a slider provided slidably on said guide bar and driven by said cam to slide on said guide bar, said slider compressing said spring while also throwing the circuit breaker into an OFF state when said slider slides to a first position, and throwing the circuit breaker into an ON state when said slider slides back to a second position; and latch means for latching the slider at said first position and for releasing the latched slider upon an OFF operation signal;

an electrically powered pawl driven by said electric motor for driving said ratchet gear into rotation; and a release mechanism driven into pivotal motion by rotation of said cam for causing said electrically powered pawl to move out of engagement with said ratchet gear when said cam rotates to said predetermined position.

2. An apparatus for electrically operating a circuit breaker according to claim 1, wherein said release mechanism comprises:

a first release plate mechanically coupled with said cam, swingably provided on said frame and having an elongate hole;

a second release plate swingably provided on said frame and having a pin engaged with said hole in said first release plate, said second release plate being mechanically coupled with said electrically powered pawl to move said electrically powered pawl out of engagement with said ratchet gear when said first release plate is driven by said cam.

* * * * *